US007625168B2

(12) United States Patent
Lesko

(10) Patent No.: US 7,625,168 B2
(45) Date of Patent: Dec. 1, 2009

(54) PIPE INDEXER/KICKER WITH RAMP ENGAGING ARM

(76) Inventor: Gerald Lesko, 4807-68 Avenue, Edmonton, AB (CA) T6B 2N2

( * ) Notice: Subject to any disclaimer, the term of this patent is extended or adjusted under 35 U.S.C. 154(b) by 229 days.

(21) Appl. No.: 11/619,883

(22) Filed: Jan. 4, 2007

(65) Prior Publication Data

US 2007/0177967 A1 Aug. 2, 2007

(30) Foreign Application Priority Data

Feb. 1, 2006 (CA) ..... 2535083

(51) Int. Cl.
*B66F 11/00* (2006.01)
*B65G 15/58* (2006.01)

(52) U.S. Cl. ..... 414/746.6; 414/745.9; 198/468.6; 198/621.3

(58) Field of Classification Search ..... 198/360, 198/468.6, 468.7, 468.9, 621.3, 774.1, 750.8, 198/774.3; 414/745.4, 745.7, 745.8, 745.9, 414/746.1–746.4, 746.6–746.8
See application file for complete search history.

(56) References Cited

U.S. PATENT DOCUMENTS 526,624 A * 9/1894 Hill ..... 414/746.1
2,922,533 A * 1/1960 Barge, Jr. ..... 414/746.7
2,940,612 A * 6/1960 Shimeld ..... 414/780
4,051,775 A * 10/1977 Watson ..... 101/40.1
4,474,520 A * 10/1984 Buckner et al. ..... 414/22.61
4,533,055 A * 8/1985 Haney ..... 211/70.4
4,684,314 A * 8/1987 Luth ..... 414/746.1
5,572,898 A * 11/1996 Horde et al. ..... 72/405.16
6,899,510 B2 * 5/2005 Morelli et al. ..... 414/745.8
2006/0285941 A1 * 12/2006 Fikowski et al. ..... 414/22.54

* cited by examiner

*Primary Examiner*—Gregory W Adams
(74) *Attorney, Agent, or Firm*—Dennis T. Griggs; Scott T. Griggs; Griggs Bergen LLP

(57) ABSTRACT

A combination pipe kicker/indexer for attachment to a pipe launcher is provided. The pipe kicker includes an articulated arm that is operated by a rotating shaft. The arm has a kicker head that rises up from a frame and moves towards a pipe located in the trough of the pipe launcher. Continued rotation of the shaft causes the kicker head to push the pipe out of the trough. Reversing the shaft rotation retracts the kicker arm into its frame. The indexer includes a plate having two eccentric cam openings and a cam rotatably mounted therein. Rotation of the cams causes either end of the indexer plate to rise up from the frame and urge a section of pipe towards the pipe launcher trough.

13 Claims, 9 Drawing Sheets

PIPE INDEXER/KICKER WITH RAMP ENGAGING ARM

BACKGROUND OF THE INVENTION

1. Field of the Invention

The present invention relates to the field of pipe indexers and pipe kickers used for moving a section of pipe onto and off of a pipe launcher. More specifically, the present invention provides a combined pipe indexer and kicker within a single support frame that is attached to the pipe launcher.

2. Description of Related Art

It is desirable for reasons of safety, efficiency and improved synchronicity to have a pipe indexer and a pipe kicker combined within a single support frame such that the indexer can present a section of pipe to a pipe launcher and the kicker can eject a section of pipe from a pipe launcher.

BRIEF SUMMARY OF THE INVENTION

The present invention relates to a device known as a "pipe indexer" that is used for presenting a section of pipe to a pipe launcher which raises and presents the pipe to a drilling rig platform. The present invention also relates to a device known as a "pipe kicker" that is used to remove a section of pipe from the pipe launcher after receiving the pipe from the drilling rig platform. In a representative embodiment, the present invention is an apparatus that combines the pipe indexer and the pipe kicker into a single support frame that attaches to the pipe launcher. Typically, a plurality of combined pipe indexers/kickers are attached to either or both sides of the pipe launcher in a spaced-apart configuration.

Each of the pipe indexer and pipe kicker have drive-line connectors that permit the use of drive shafts to connect adjacent units together such that they operate substantially in unison when indexing a section of pipe into the pipe launcher or ejecting from the pipe launcher. The pipe indexer consists of a vertical plate disposed within a support frame that mounts perpendicularly to the pipe launcher. The plate has a shallow concave groove at the end furthest from the pipe launcher to hold the pipe. The indexer plate, itself, has two openings extending there through for receiving an eccentric cam mounted on a shaft. As either shaft turns, the cam raises or lowers the indexer plate with respect to the support frame. When the shaft is turned with sufficient force, the indexer is able to flip a section of pipe forward to the pipe launcher trough.

The pipe kicker of the present invention consists of a first arm that is rotatably attached at one end to a drive-line connector disposed in a lower portion of the support frame. The other end of the first arm is rotatably attached to a kicker arm via an elbow joint. The kicker arm has a guide roller attached thereon that rolls on a guide ramp disposed within the support frame. When the drive-line connector is turned, the first arm rotates towards the pipe launcher causing the guide roller to roll off the guide ramp. This, in turn, causes the kicker arm to rise up from the support frame. A kicker head on the kicker arm has at least one roller for rolling on the top surface of the pipe launcher. The kicker has further rollers on its face for rolling against sections of pipe. As the first arm continues to rotate towards the pipe launcher, the kicker head moves towards and enters the pipe launcher trough to push a section of pipe out of the trough. Once the pipe is ejected from the trough, the first arm is rotated away from the pipe launcher which causes the kicker arm to retract within the support frame.

It is an object of the present invention to provide a combined pipe kicker and indexer within a single support frame, wherein, the support frame attaches to the pipe launcher, the indexer provides a means for presenting a section of pipe to a pipe launcher and the kicker provides a means for ejecting a section of pipe from a pipe launcher.

It is another object of the present invention to provide a pipe kicker having a pivot connection point comprising drive line connectors capable of coupling a plurality of spaced-apart pipe kickers together with drive shafts thereby enabling said plurality of pipe kickers to operate substantially in unison.

Yet another object of the present invention to provide an indexer having an indexer plate comprised of a cam opening disposed in each of said near and far ends and said first and second indexer mechanisms comprising a horizontal shaft passing through said frame in said cam openings and an eccentric cam mounted on each shaft, said cams disposed within said cam openings.

Yet another object of the present invention to provide an indexer having indexer mechanisms comprised of drive-line connectors capable of coupling a plurality of space-apart indexers together with drive shafts thereby enabling said plurality of indexers to operate substantially in unison.

Broadly stated, one aspect of the present invention is a pipe kicker for ejecting a section of pipe from a pipe launcher, comprising: a supporting frame having a top surface and a first opening thereon, said frame adapted for operatively attaching to a pipe launcher; a first arm having proximal and distal ends, said first arm substantially disposed within said frame, said proximal end rotatably coupled to said frame at a pivot connection point whereby said first arm is capable of rotation about a substantially horizontal first axis passing through said pivot connection point, said first axis substantially perpendicular to said frame, said distal end further comprising an elbow joint; a kicker arm having first and second ends, said kicker arm substantially disposed within said frame, said first end rotatably coupled to said elbow joint of said first arm whereby said kicker arm is capable of rotation about a second axis passing through said elbow joint, said second axis substantially parallel to said first axis, said second end of said kicker arm further comprising a kicker head adapted for ejecting a section of pipe from a pipe launcher; a guide ramp disposed within said frame adapted to guide said kicker arm; and a guide roller disposed on said kicker arm, said guide roller adapted to roll on said guide ramp whereby said kicker arm is capable of moving from a first position where said kicker arm is substantially disposed within said frame to a second position after applying a rotational force to said first arm at said pivot connection point whereupon said guide roller rolls up said guide ramp causing said kicker arm to rise up from said frame through said first opening and move said kicker head towards a pipe launcher to eject a section of pipe from said pipe.

Broadly stated, another aspect of the present invention is an indexer for presenting a section of pipe to a pipe launcher, comprising: a supporting frame having a top surface and a first opening thereon, said frame adapted for operatively attaching to said pipe launcher, said frame substantially perpendicular to a pipe launcher; an indexer plate having a near end and a far end, said far end having a pipe groove for receiving a section of pipe, said indexer plate substantially disposed within said frame; a first indexer mechanism disposed within said frame adapted to raise said far end of said indexer plate up through said first opening above said top surface; and a second indexer mechanism disposed with said frame adapted to raise said near end of said indexer plate up through said first opening above said top surface.

Broadly stated, another aspect of the present invention is an apparatus adapted for ejecting a section of pipe from a pipe launcher and for presenting a section of pipe to a pipe launcher, comprising: a supporting frame having a top surface and first and second openings located thereon, said frame adapted for operatively attaching to a pipe launcher; a first arm having proximal and distal ends, said first arm substantially disposed within said frame, said proximal end rotatably coupled to said frame at a pivot connection point where said first arm is capable of rotation about a substantially horizontal first axis passing through said pivot connection point, said first axis substantially perpendicular to said frame, said distal end further comprising an elbow joint; a kicker arm having first and second ends, said kicker arm substantially disposed within said frame, said first end rotatably coupled to said elbow joint of said first arm whereby said kicker arm is capable of rotation about a second axis passing through said elbow joint, said second axis substantially parallel to said first axis, said second end of said kicker arm further comprising a kicker head adapted for ejecting a section of pipe from a pipe launcher; a guide ramp disposed within said frame, said guide ramp adapted to guide said kicker arm; a guide roller disposed on said kicker arm, said guide roller adapted to roll on said guide ramp whereby said kicker arm is capable of moving from a first position where said kicker arm is substantially disposed within said frame, to a second position after applying a rotation force to said first arm at said pivot connection point whereupon said the guide roller rolls up said guide ramp causing said kicker arm to rise up from said frame through said first opening and move towards a pipe launcher to eject a section of pipe; an indexer plate disposed substantially within said frame, said indexer plate having a near end and a far end, said far end comprising a pipe groove for receiving a section of pipe; a first indexer mechanism disposed within said frame adapted to raise said far end of said indexer plate up through said second opening above said top surface; and a second indexer mechanism disposed within said frame adapted to raise said near end of said indexer plate up through said second opening above said top surface.

DETAILED DESCRIPTION OF THE INVENTION

Figure 1:
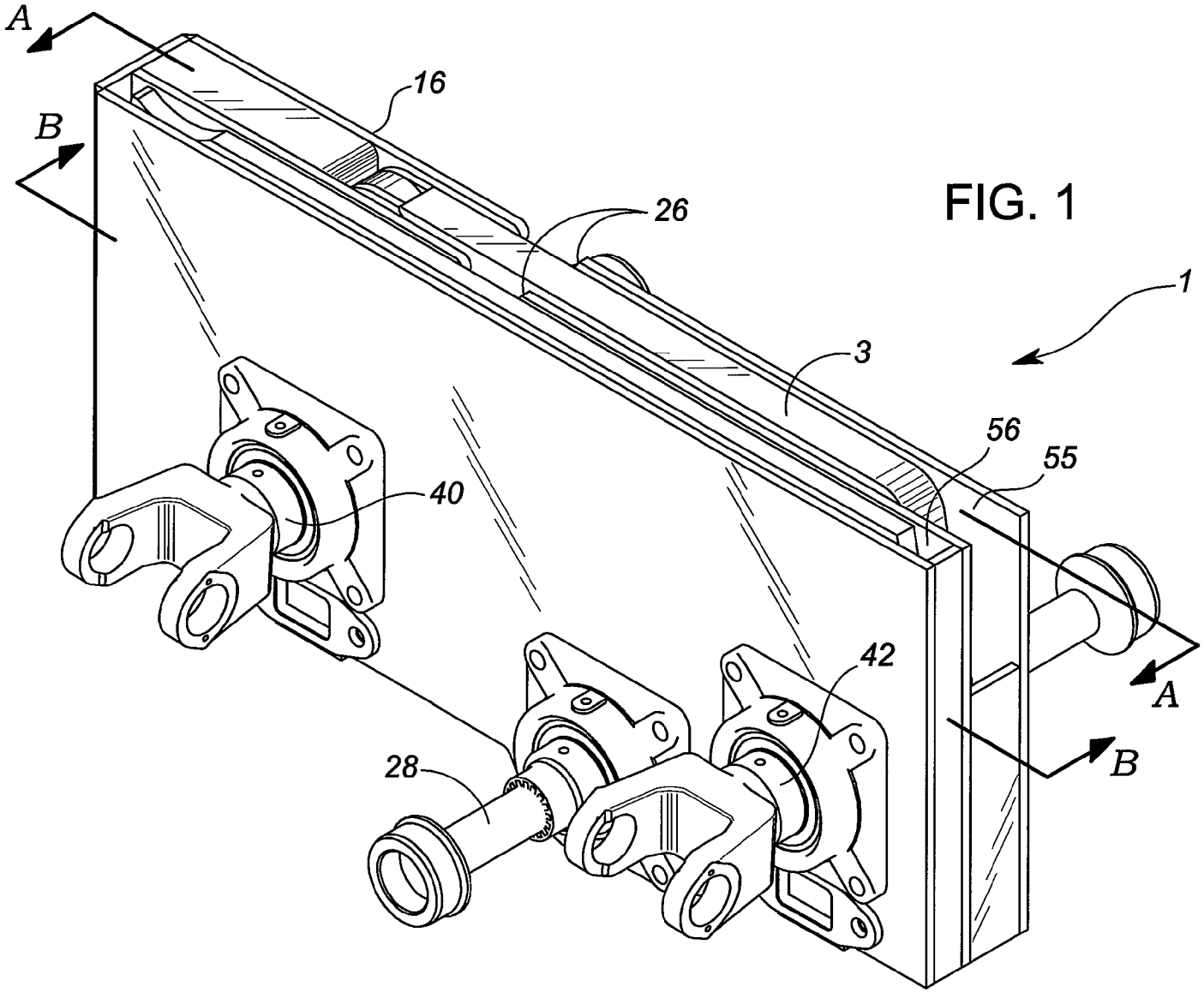
FIG. 1 is a left front perspective view of a combination indexer/kicker in accordance with a representative embodiment of the present invention.

Referring to FIG. 1, the pipe kicker/indexer 1 in accordance with a representative embodiment of the present invention as shown. Kicker/indexer 1 comprises frame 16, kicker 3 disposed within frame 16 through opening 55, indexer 62 disposed in frame 16 through opening 56, kicker drive-line 28, and indexer drive-lines 40 and 42.

Figure 2:
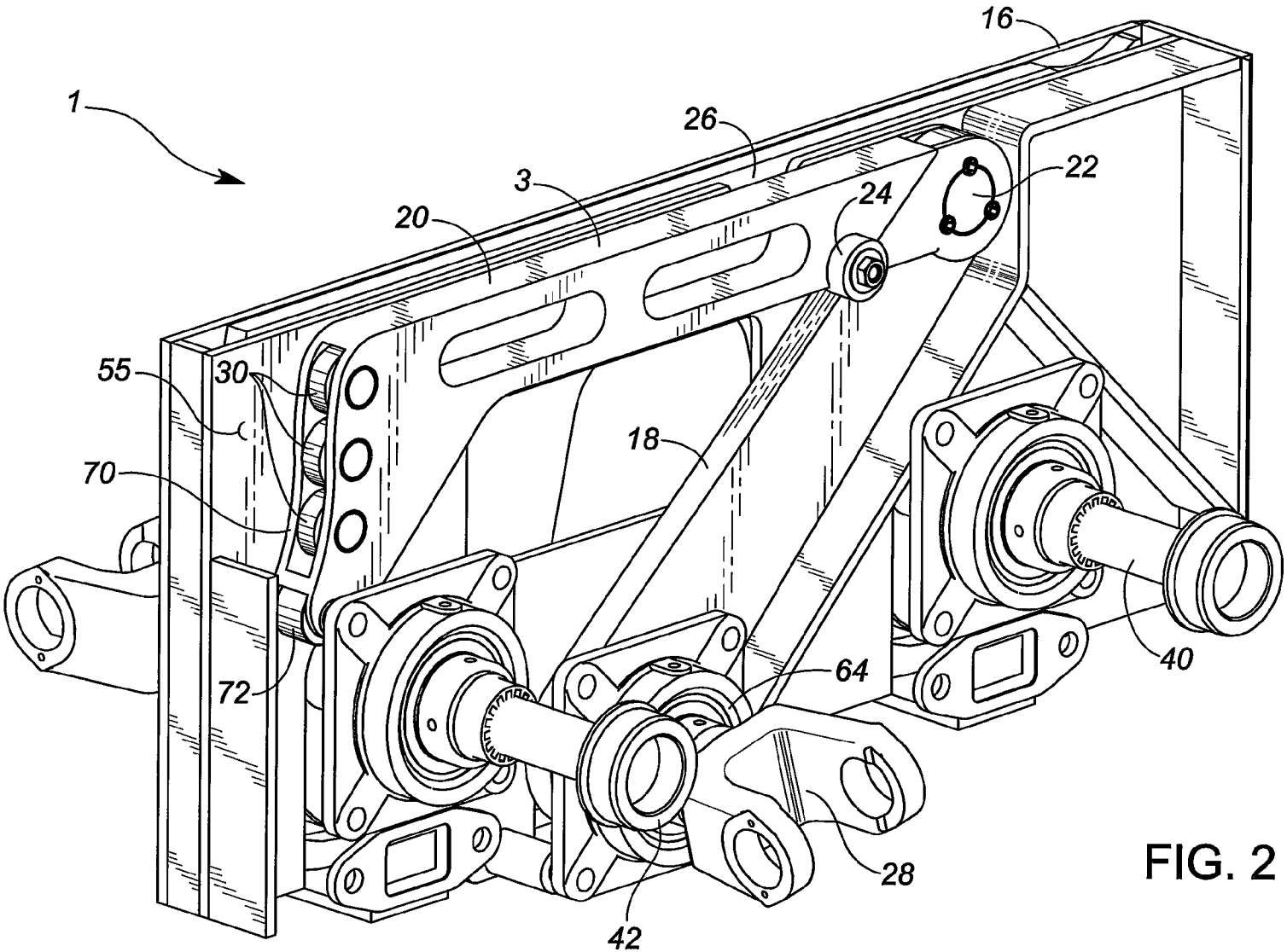
FIG. 2 is a right front perspective view depicting the combination indexer/kicker of FIG. 1 shown along section lines A-A.
Figure 3:
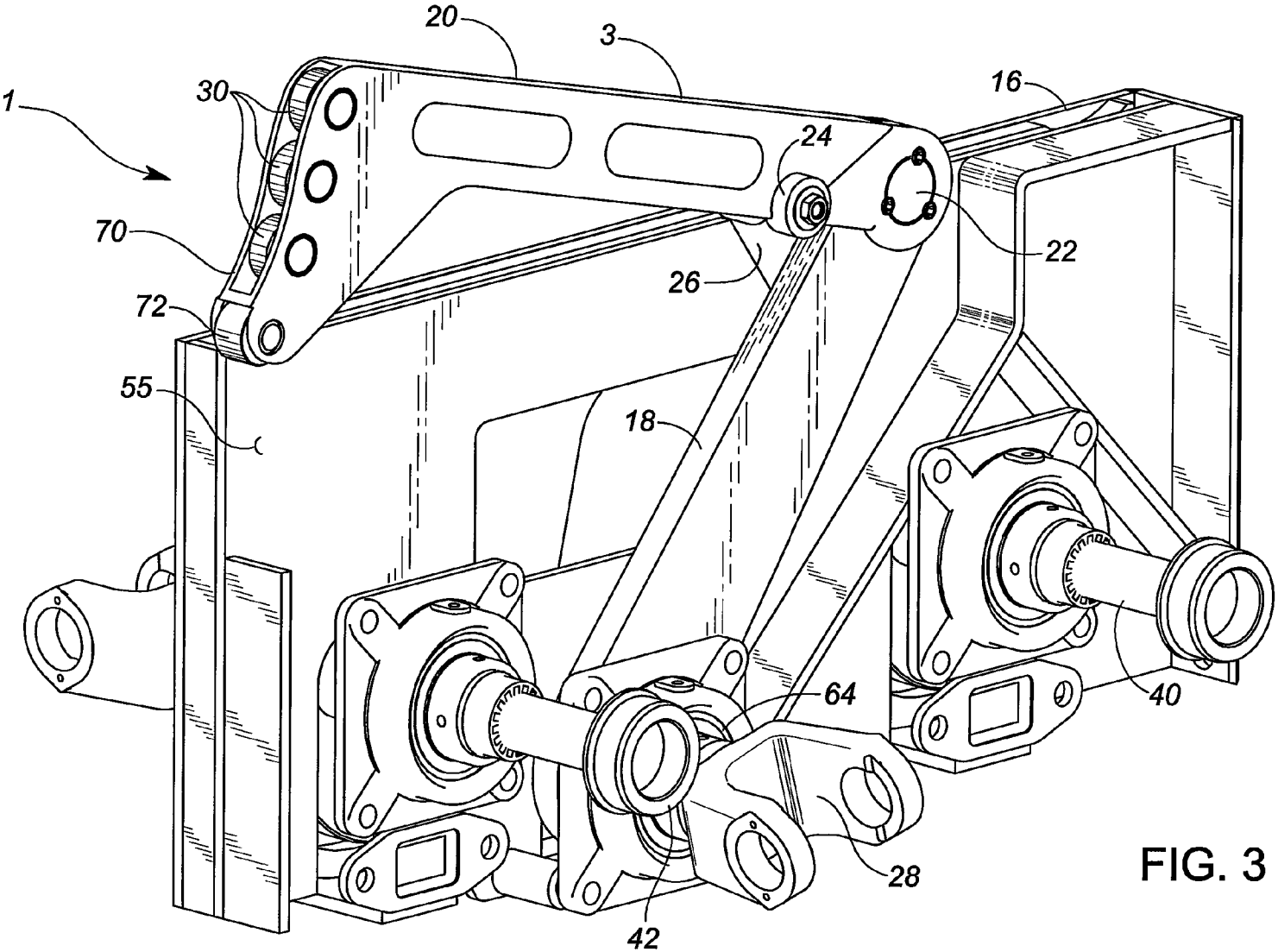
FIG. 3 is a right front perspective view depicting the combination indexer/kicker of Figure shown along section lines A-A with the kicker arm being raised.
Figure 4:
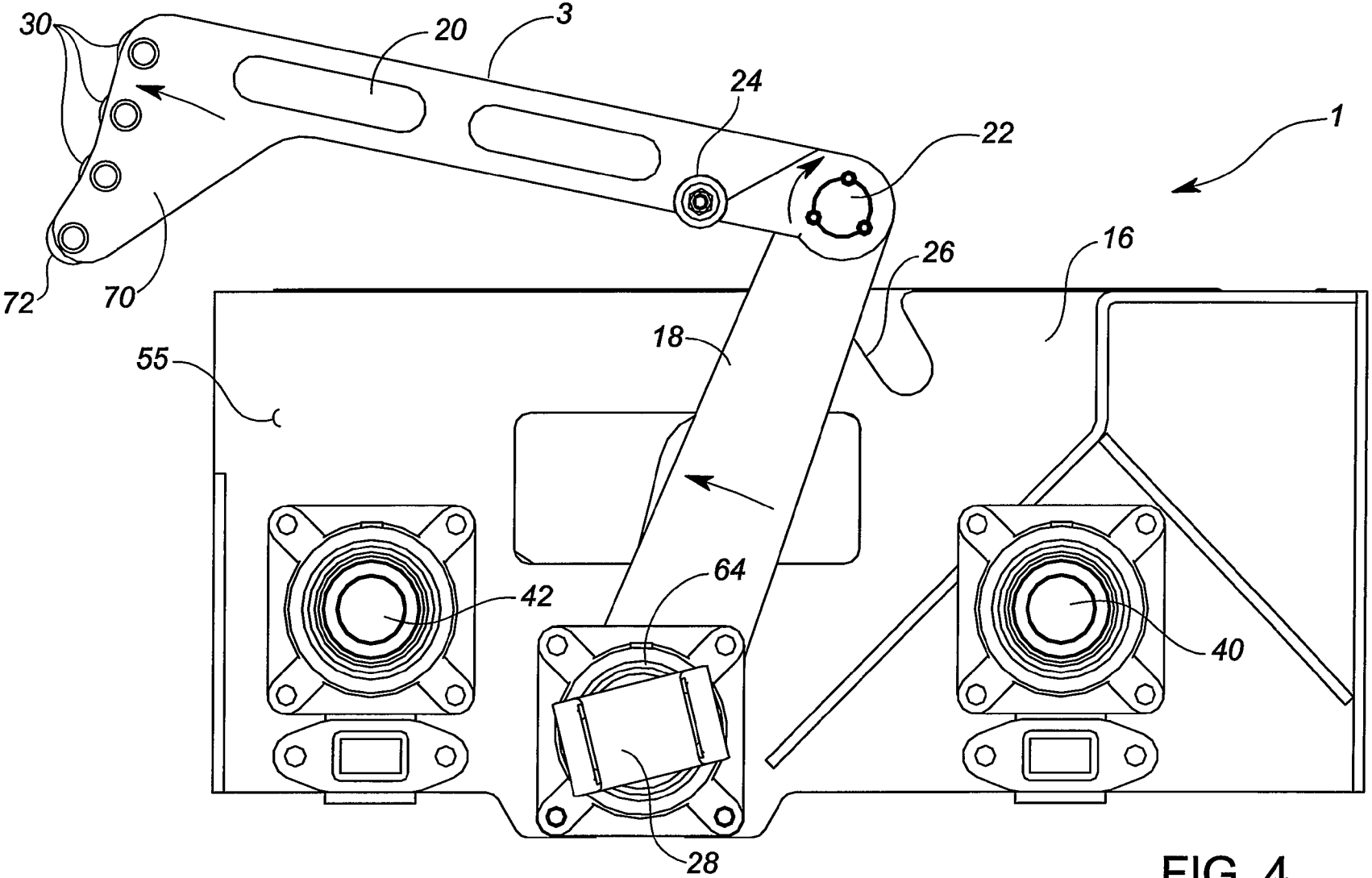
FIG. 4 is a right side elevational view depicting the combination indexer/kicker of FIG. 1 shown along section lines A-A with the kicker arm in an extend position.

Referring to FIGS. 2, 3 and 4, kicker 3 is shown in various positions. These figures are shown along section lines A-A revealing the internal mechanisms underneath the right-side cover of frame 16. Kicker 3 comprises first arm 18 which is rotatably coupled to frame 16 at pivot connection point 64. Drive-line 28 is coupled to first arm 18 at pivot connection point 64. First arm 18 is also pivotally connected to kicker arm 20 at pivot elbow joint 22. Located near pivot elbow joint 22 along kicker arm 20 are guide rollers 24. Guide rollers 24 ride on guide ramps 26 located on frame 16. Kicker arm 20 further includes kicker head 70 that has head guide roller 72 and pipe rollers 30.

In FIG. 2, kicker 3 is shown in a retracted position within frame 16 when it is not in use.

In FIG. 3, kicker 3 is shown rising out of frame 16 when a rotational force is applied to kicker drive-line 28. From the view shown in FIG. 3, a counterclockwise rotational force on kicker drive-line 28 turns first arm 18 up through opening 55. This causes guide rollers 24 to ride up guide ramps 26 and raise kicker arm 20 up from frame 16 and in a forward direction.

Referring to FIG. 4, as kicker drive-line 28 continues to rotate, kicker head 70 will move away from frame 16. Head guide roller 72 rolls on top of a pipe launcher platform (not shown) as kicker 3 continues to move forward. As will be discussed further in this specification, kicker head 70 will continue to roll towards a pipe launcher trough (not shown) and eject a section of pipe contained in the trough. Reversing the rotation on kicker drive-line 28 will return kicker 3 to its retracted position within frame 16.

Figure 5:
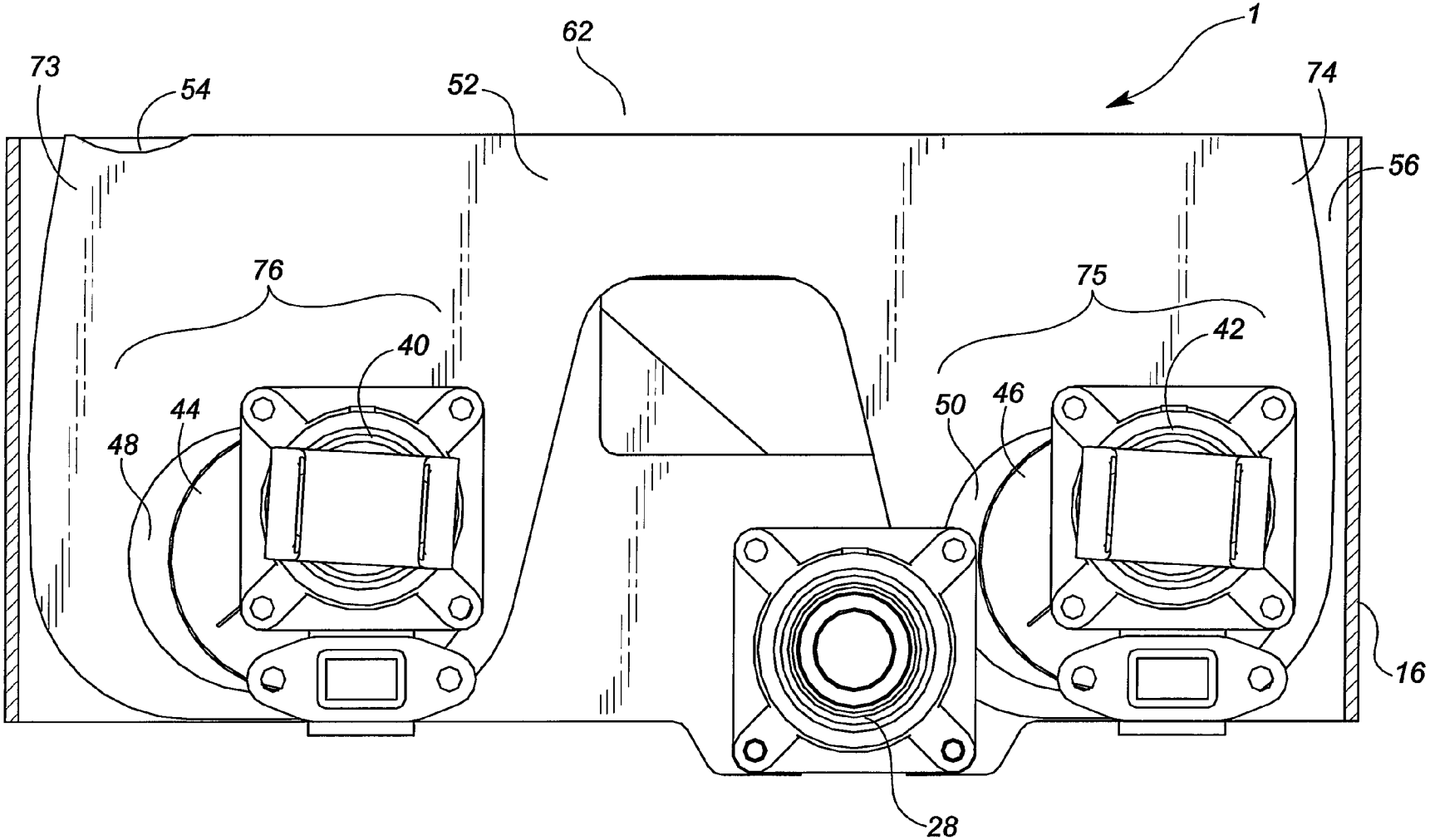
FIG. 5 is a left side elevational view depicting the combination indexer/kicker of Figure shown along section lines B-B.

In FIG. 5, the pipe indexer in accordance with a representative embodiment of the present invention is shown. This figure is shown along section lines B-B revealing internal mechanisms under the left-side cover of frame 16. Indexer 62 includes indexer plate 52 having cam openings 48 and 50. Cams 44 and 46 are positioned within cam openings 48 and 50, respectively. Cam 44 and cam opening 48 in combination with indexer drive-line 40 make up far end indexer mechanism 76. Cam 46 and cam opening 50 in combination with indexer drive-line 42 make up near end indexer mechanism 75. The references to near end and far end refer to the position of the indexer in respect of a pipe launcher to which kicker/indexer 1 is positioned adjacent to. At far end 73 of indexer plate 52 is pipe groove 54 for receiving a section of pipe (not shown). Upon rotating either drive-line 40 or 42, cam 44 or 46 will rotate within cam opening 48 or 50 to raise far end 73 or near end 74, respectfully, of indexer plate out of frame 16 through opening 56.

Figure 6:
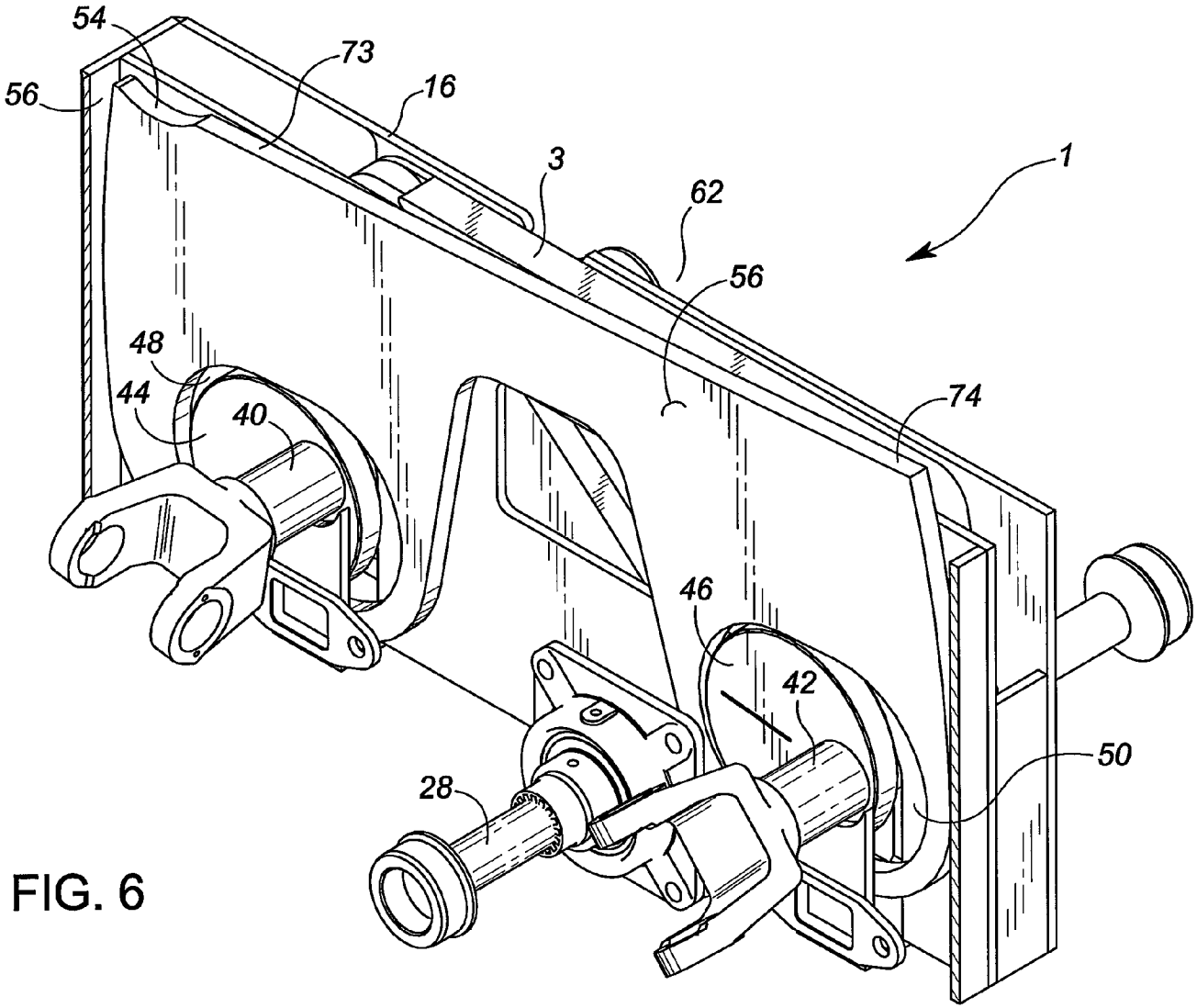
FIG. 6 is a left front perspective view depicting the combination indexer/kicker of FIG. 1 shown along section lines B-B with the near end of the indexer plate in a raised position.
Figure 7:
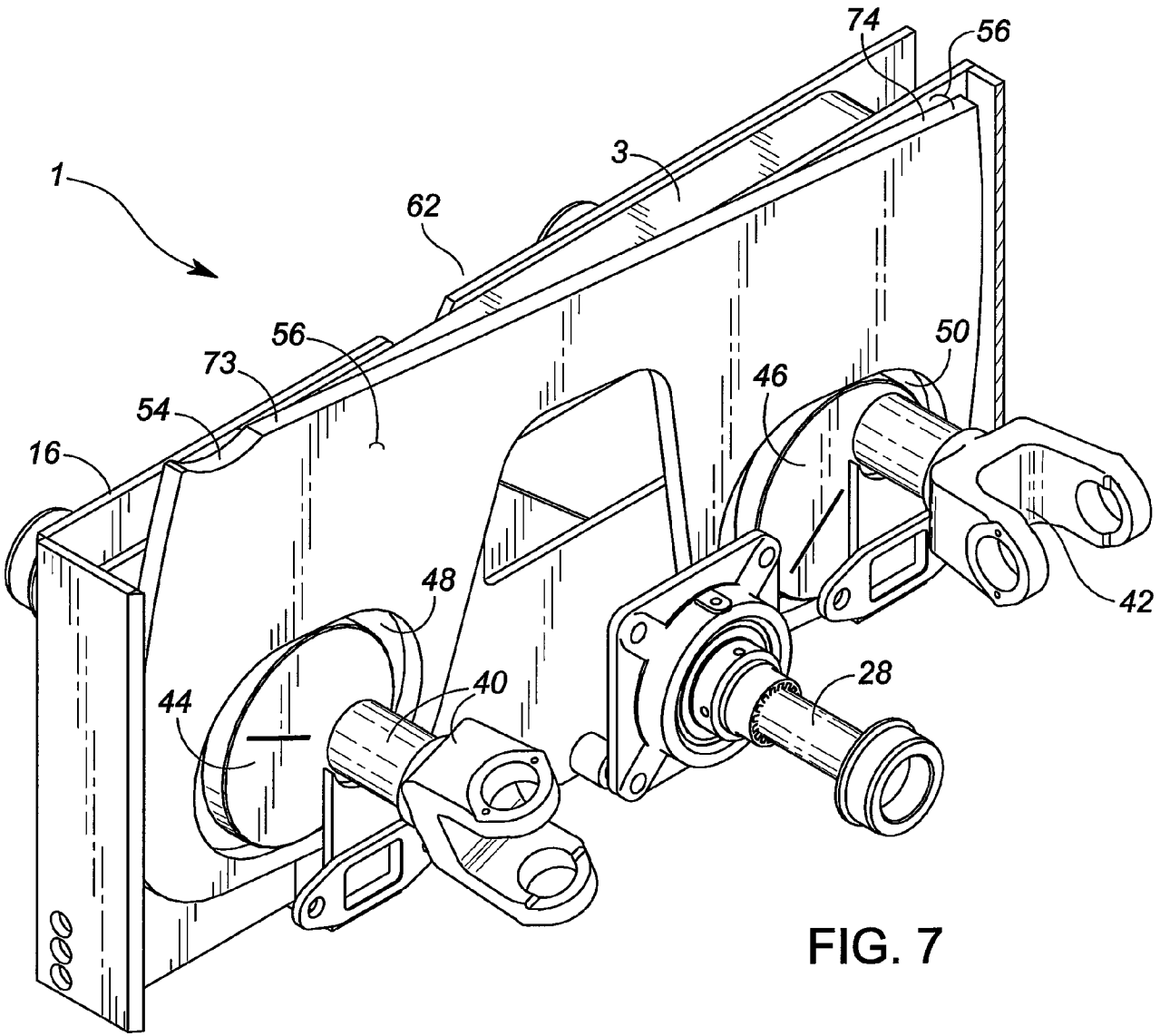
FIG. 7 is a left rear perspective view depicting the combination indexer/kicker of FIG. 1 shown along section lines B-B with the far end of the indexer plate in a raised position.

Referring to FIG. 6, cam 46 is shown rotated by drive-line 42. As cam 46 is rotated within cam opening 50, near end 74 rises up through opening 56. Referring to FIG. 7, cam 44 shown rotated by drive-line 40. As cam 44 turns within cam opening 48, far end 73 rises up through opening 56.

Figure 8:
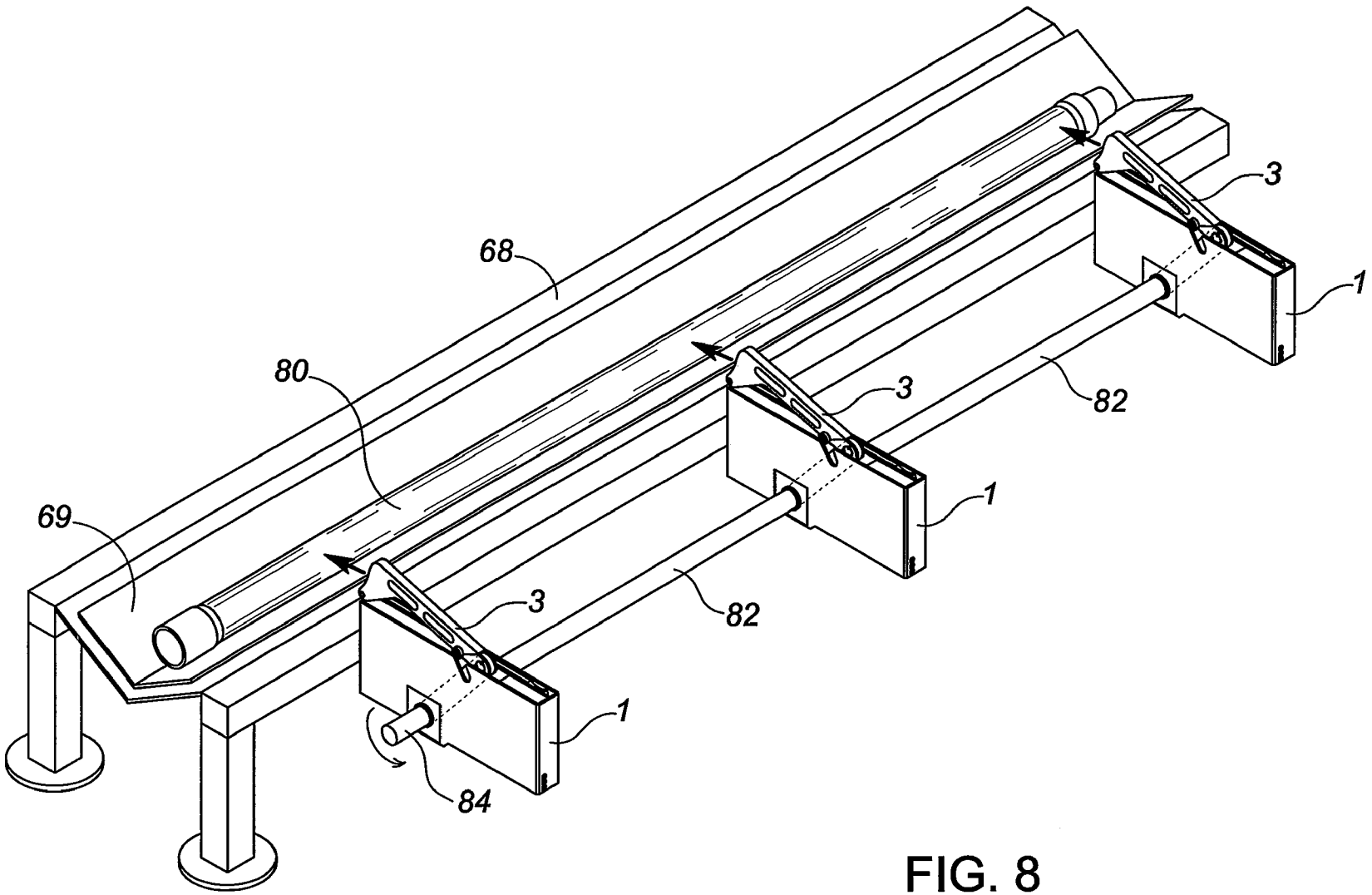
FIG. 8 is a perspective view of a pipe being ejected from a pipe launcher with the indexer/kicker of FIG. 1.

Referring to FIG. 8, the pipe kicker in accordance with a representative embodiment of the present invention is shown in operation. Kicker/indexer is attached to pipe launcher 68. In this example, there are three kicker/indexers 1 operatively coupled to the side of pipe launcher 18. Kicker/indexer 1 are placed spread along pipe launcher 68 in a spaced apart fashion. It should be obvious to one skilled in the art that a minimum of two kicker/indexers 1 would be required to eject pipe 80 from trough 69 whereas longer lengths of pipe and, hence, longer troughs 69 may require three or more kicker/indexers 1 positioned along pipe launcher 68. As shown in this example, drive-lines 82 couple kicker/indexers 1 together such that when a rotational force is applied to input shaft 84, all kicker/indexers 1 will operate substantially in unison. To eject pipe 80 from trough 69 of pipe launcher 68, rotational force is applied to input shaft 84 to cause kickers 3 to rise up and move towards pipe launcher 68 to push pipe 80 out of trough 69. It should be obvious to a person skilled in the art that any suitable mechanism may be used to provide the rotational force to input shaft 84 such as electrical or hydraulically operated motors or hydraulic rams coupled to a crank attached to input shaft 84.

Figure 9:
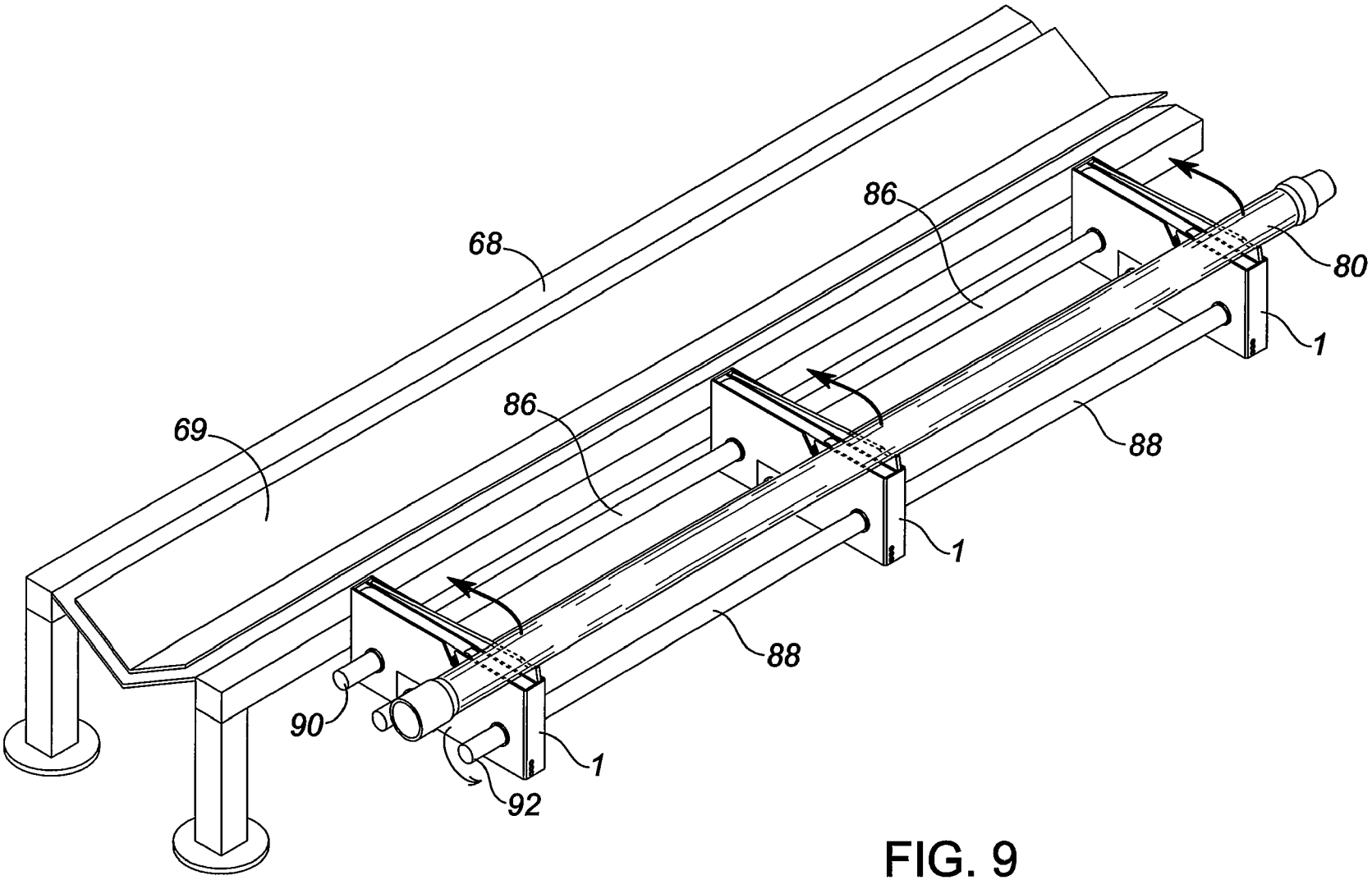
FIG. 9 is a perspective view of a pipe being indexed into a pipe launcher with the indexer/kicker of FIG. 1.

In FIG. 9, kicker/indexers 1 are shown in operation to present pipe 80 to pipe launcher 68. In this example, there are three kicker/indexers 1 positioned in a spaced apart fashion along pipe launcher 68. It should be obvious to one skilled in the art that a minimum of two kicker/indexers 1 would be required to balance a section of pipe 80 whereas three or more kicker/indexers 1 may be required for longer lengths of pipe 80. Drive-lines 86 and 88 connect cam mechanism 75 and 76 of the kicker/indexers 1 such that kicker/indexers 1 operate substantially in unison. In operation, pipe 80 is loaded on to kicker/indexers 1 from a pipe rack (not shown). As discussed above in respect of kicker 3, any suitable means may be used to rotate drive-lines 86 and 88 by applying rotational forces to input shafts 90 or 92. After pipe 80 has been loaded onto kicker/indexers 1, rotational forces are applied to either of input shafts 90 or 92 to balance pipe 80 along indexer plate 52 and to position it within pipe groove 54. Rotational force is then applied to input shaft 92 to turn drive-lines 88 and indexer mechanism 75 to raise far ends 73 of indexer plates 52 which result in pipe 80 being flipped towards trough 69.

Although a few preferred embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. A pipe kicker for ejecting a section of pipe from a pipe launcher, comprising:

a supporting frame having a top surface and a first opening thereon, said frame adapted for operatively attaching to a pipe launcher;

a first arm having proximal and distal ends, said first arm substantially disposed within said frame, said proximal end rotatably coupled to said frame at a pivot connection point whereby said first arm is capable of rotation about a substantially horizontal first axis passing through said pivot connection point, said first axis substantially perpendicular to said frame, said distal end further comprising an elbow joint;

a kicker arm having first and second ends, said kicker arm substantially disposed within said frame, said first end rotatably coupled to said elbow joint of said first arm whereby said kicker arm is capable of rotation about a second axis passing through said elbow joint, said second axis substantially parallel to said first axis, said second end of said kicker arm further comprising a kicker head adapted for ejecting a section of pipe from a pipe launcher, wherein said kicker head comprises at least one roller for rolling on a top surface of said pipe launcher;

a guide ramp disposed within said frame adapted to guide said kicker arm; and a guide roller disposed on said kicker arm, said guide roller adapted to roll on said guide ramp whereby said kicker arm is capable of moving from a first position where said kicker arm is substantially disposed within said frame to a second position after applying a rotational force to said first arm at said pivot connection point whereupon said guide roller rolls up said guide ramp causing said kicker arm to rise up from said frame through said first opening and move said kicker head towards a pipe launcher to eject a section of pipe from said pipe.

2. The pipe kicker as set forth in claim 1, wherein said pivot connection point further comprises at least one drive line connector capable of coupling said pipe kicker with at least one other pipe kicker operatively attached to a pipe launcher with a drive shaft thereby enabling said pipe kickers to operate substantially in unison.

3. The pipe kicker as set forth in claim 1, wherein said kicker head further comprises at least one additional roller for rolling against a section of pipe.

4. The pipe kicker as set forth in claim 1, further comprising a pipe launcher, said pipe kicker operatively attached to said pipe launcher and adapted to eject a section of pipe from said pipe launcher.

5. An indexer for presenting a section of pipe to a pipe launcher, comprising:

a supporting frame having a top surface and a first opening thereon, said frame adapted for operatively attaching to said pipe launcher, said frame substantially perpendicular to a pipe launcher;

an indexer plate having a near end and a far end, said far end having a pipe groove for receiving a section of pipe, said indexer plate substantially disposed within said frame;

a first indexer mechanism disposed within said frame adapted to raise said far end of said indexer plate up through said first opening above said top surface; and a second indexer mechanism disposed with said frame adapted to raise said near end of said indexer plate up through said first opening above said top surface; wherein said indexer plate further comprises a first cam opening disposed in said far end and a second cam opening disposed is said near end, and wherein each indexer mechanisms comprises a horizontal shaft passing through said frame via its respective cam opening and an eccentric cam mounted on each shaft, said cams disposed within said cam openings whereby turning one or both of said horizontal shafts turns said cams within said cam openings causes said indexer plate to raise or lower.

6. The indexer as set forth in claim 5, wherein each of said indexer mechanisms further comprises at least one drive line connector capable of coupling said indexer with at least one other indexer operatively attached to said pipe launcher with a drive shaft thereby enabling said indexers to operate substantially in unison.

7. The indexer as set forth in claim 5, further comprising a pipe launcher, said indexer operatively attached to said pipe launcher and adapted to present a section of pipe to said pipe launcher.

8. An apparatus adapted for ejecting a section of pipe from a pipe launcher and for presenting a section of pipe to a pipe launcher, comprising:

a supporting frame having a top surface and first and second openings located thereon, said frame adapted for operatively attaching to a pipe launcher;

a first arm having proximal and distal ends, said first arm substantially disposed within said frame, said proximal end rotatably coupled to said frame at a pivot connection point where said first arm is capable of rotation about a substantially horizontal first axis passing through said pivot connection point, said first axis substantially perpendicular to said frame, said distal end further comprising an elbow joint;

a kicker arm having first and second ends, said kicker arm substantially disposed within said frame, said first end rotatably coupled to said elbow joint of said first arm whereby said kicker arm is capable of rotation about a second axis passing through said elbow joint, said second axis substantially parallel to said first axis, said second end of said kicker arm further comprising a kicker head adapted for ejecting a section of pipe from a pipe launcher;

a guide ramp disposed within said frame, said guide ramp adapted to guide said kicker arm;

a guide roller disposed on said kicker arm, said guide roller adapted to roll on said guide ramp whereby said kicker arm is capable of moving from a first position where said kicker arm is substantially disposed within said frame, to a second position after applying a rotation force to said first arm at said pivot connection point whereupon said the guide roller rolls up said guide ramp causing said kicker arm to rise up from said frame through said first opening and move towards a pipe launcher to eject a section of pipe;

an indexer plate disposed substantially within said frame, said indexer plate having a near end and a far end, said far end comprising a pipe groove for receiving a section of pipe;

a first indexer mechanism disposed within said frame adapted to raise said far end of said indexer plate up through said second opening above said top surface; and a second indexer mechanism disposed within said frame adapted to raise said near end of said indexer plate up through said second opening above said top surface; wherein said indexer plate further comprises a first cam opening disposed in said far end and a second cam opening disposed in said near end, and wherein each indexer mechanism comprises a horizontal shaft passing through said frame via its respective cam opening and an eccentric cam mounted on each shaft, said cams disposed within said cam openings whereby turning said horizontal shaft turns said cams within said cam openings causes said indexer plate to raise or lower.

9. The apparatus as set forth claim 8, wherein said pivot connection point further comprises at least one drive line connector capable of coupling said apparatus with at least one other apparatus kicker with a drive shaft thereby enabling said apparatuses to operate substantially in unison to eject a section of pipe from a pipe launcher.

10. The apparatus as set forth in claim 8 wherein said kicker head comprises at least one roller for on a top surface of a pipe launcher.

11. The apparatus as set forth in claim 10 wherein said kicker head comprises at least one additional roller for rolling against a section of pipe.

12. The apparatus as set forth in claim 8, wherein each of said indexer mechanisms further comprises at least one drive line connector capable of coupling said apparatus with at least one other apparatus operatively attached to a pipe launcher with a drive shaft thereby enabling said indexer mechanisms to operate substantially in unison to present a section of pipe to a pipe launcher.

13. The apparatus as set forth in claim 8 further comprising a pipe launcher, said apparatus operatively attached to said pipe launcher, said apparatus adapted to eject a section of pipe from said pipe launcher, and said apparatus further adapted to present a section of pipe to said pipe launcher.

* * * * *